US007629991B2

(12) United States Patent
Ohkawara

(10) Patent No.: US 7,629,991 B2
(45) Date of Patent: Dec. 8, 2009

(54) WRITING CONTROLLING DEVICE AND A COLOR IMAGE FORMING APPARATUS

(75) Inventor: Hisakazu Ohkawara, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 418 days.

(21) Appl. No.: 11/475,900

(22) Filed: Jun. 28, 2006

(65) Prior Publication Data

US 2007/0013762 A1 Jan. 18, 2007

(30) Foreign Application Priority Data

Jun. 28, 2005 (JP) ..... 2005-188460

(51) Int. Cl.
*B41J 2/435* (2006.01)
*B41J 2/47* (2006.01)

(52) U.S. Cl. ..... 347/234; 347/248

(58) Field of Classification Search ..... 347/116, 347/229, 234, 235, 248–250; 716/1
See application file for complete search history.

(56) References Cited

U.S. PATENT DOCUMENTS 6,336,204 B1 * 1/2002 Jevtic ..... 716/1

FOREIGN PATENT DOCUMENTS

| | | | |
|---|---|---|---|
| JP | 08-142412 | | 6/1996 |
| JP | 10078734 | A * | 3/1998 |
| JP | 10-1886787 | | 7/1998 |
| JP | 10-239939 | | 9/1998 |
| JP | 10239939 | A * | 9/1998 |
| JP | 2000-356875 | | 12/2000 |
| JP | 2005181655 | A * | 7/2005 |

* cited by examiner

*Primary Examiner*—Hai C Pham
(74) *Attorney, Agent, or Firm*—Oblon, Spivak, McClelland, Maier & Neustadt, P.C.

(57) ABSTRACT

A write controlling device for an image forming apparatus including a time lag detecting device configured (i) to detect a time lag between (a) synchronization signal generated by a synchronization detecting device and (b) a mark signal generated by a mark sensor configured to detect a mark on a transfer belt configured to transfer plural color toner components; and (ii) to output a white line insertion value using the detected time lag; and a reconfiguration device configured to reconfigure the white line insertion value and a write timing setting value defining a writing start position in a sub-scanning direction using a write timing ancillary value which defines the quantity of reconfiguration.

4 Claims, 9 Drawing Sheets

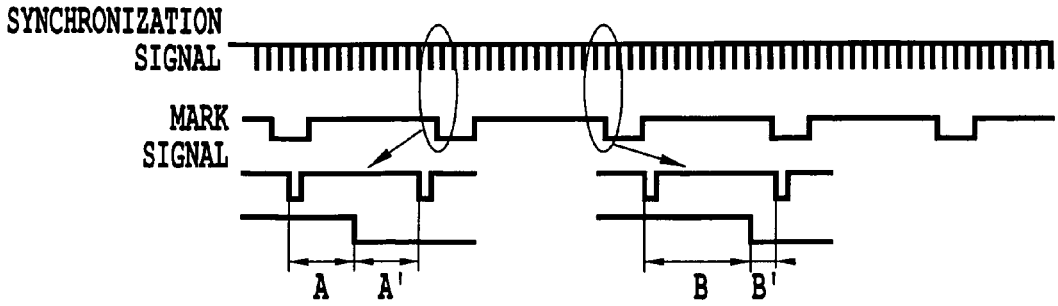
*Fig. 4*
| | | | |
|---|---|---|---|
| FIRST LINE DATA | WHITE DATA | WHITE DATA | WHITE DATA |
| SECOND LINE DATA | FIRST LINE DATA | WHITE DATA | WHITE DATA |
| THIRD LINE DATA | SECOND LINE DATA | FIRST LINE DATA | WHITE DATA |
| FOURTH LINE DATA | THIRD LINE DATA | SECOND LINE DATA | FIRST LINE DATA |
*Fig. 5*
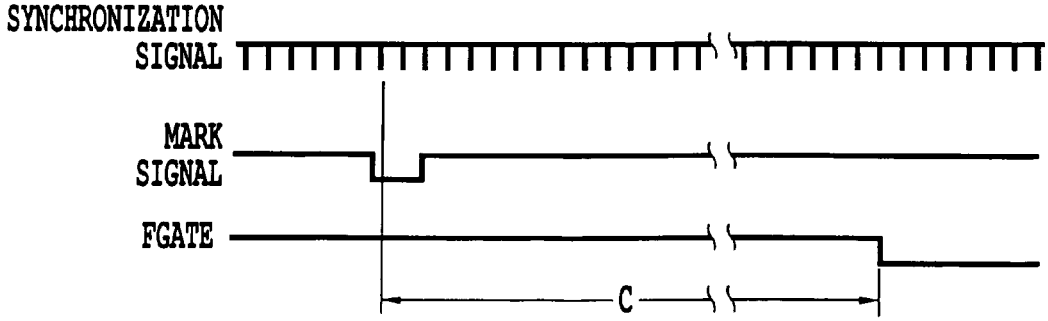
*Fig. 6*

WRITING CONTROLLING DEVICE AND A COLOR IMAGE FORMING APPARATUS

CROSS-REFERENCE TO RELATED APPLICATIONS

This application claims priority pursuant to 15 U.S.C. 119 to Japanese patent application 2005-188460 filed in the Japanese Patent Office on Jun. 28, 2005, the entire contents of which are hereby incorporated herein by reference.

BACKGROUND OF THE INVENTION

1. Field of the Invention

The present invention relates to various write controlling devices or color image forming apparatuses such as a copier, color printer, color facsimile, or color multi-function peripheral, etc., having a multiple-beam scanning device.

More particularly, the present invention relates to a technology for preventing color shifting (the position shifting of the toner image of the respective colors) in a sub-scanning direction.

2. Description of the Background

Conventionally, color image forming apparatuses (and methods) form a color image by using a single laser light source. In these cases, a photosensitive body moves in a sub-scanning direction by way of a rotational drive force created by the rotational driving section and is uniformly charged by a charging mechanism. One line of laser beam emitted from the single laser light source is scanned, or moved in a predetermined direction, by a scanning mechanism, such as a rotating polygon mirror, etc., and radiated to the charged surface of the photosensitive body. Using the beam, plural color images are sequentially written on the charged surface of the photosensitive body as electrostatic latent images.

The electrostatic latent images of the plural colors thus formed are developed by plural developing media and are thereby converted to respective visible toner images of plural colors. The toner images of plural colors formed on the photosensitive body are superposedly transferred respectively onto an intermediate transfer body by using a transfer mechanism. Thereby, a full-color image can be formed on the transfer mechanism.

The full-color image thus transferred onto the intermediate transfer body is further transferred onto a transfer material such as recording paper, OHP sheet, etc. and conveyed from a paper feeding apparatus by use of the (other) transfer body. The transfer material having the full-color image with the transferred image thereon is discharged from the color image forming apparatus.

Hereupon, the scanning mechanism is rotatively driven by a motor, etc. with a predetermined revolving velocity. A line synchronization signal generating mechanism detects a light beam (laser beam) from the scanning mechanism at a predetermined position and generates a line synchronization signal. The laser beam is modulated by the image signal in synchronism with the line synchronization signal, and thus the image writing operation is performed line by line.

An intermediate transfer standard signal generating mechanism detects a mark on the intermediate transfer body at a predetermined position and generates an intermediate transfer standard signal. The image forming operation of the respective colors for forming the toner images of the respective colors on the photosensitive body is performed in synchronism with the intermediate transfer standard signal.

In such a color image forming apparatus, when high efficiency is required, it is necessary to raise the revolution rate of the scanning mechanism or the frequency of the image signal. However, the revolution rate of the scanning mechanism or the frequency of the image signal are limited and the color image forming operation consequently could not always be performed with the desired speed. In order to cope with such problems, there has been proposed a color image forming apparatus in the multiple-beam system having a plurality of laser light sources.

In such a multiple-beam system color image forming apparatus, plural laser beams emitted from plural laser light rays are scanned by the scanning mechanism such as a polygon mirror, etc., and radiated to the charged surface of the photosensitive body. Thereby, the images are simultaneously written on the photosensitive body.

The line synchronization signal generating mechanism detects the light beam from the scanning mechanism at the predetermined position and generates one line synchronization signal per light beam. The plural lines of laser beams are modulated by the image signal in synchronism with the line synchronization signal, and the writing operations of the image per plural lines are performed simultaneously. Consequently, since the amount of the information to be written on the photosensitive body is increased, the revolution rate of the scanning mechanism or the frequency of the image signal can be reduced, and thereby the stable image can be formed with high speed.

On the other hand, in such multiple-beam system color image forming apparatuses, since the intermediate transfer standard signal is not synchronized with the line synchronization signal, there is a probability that, the higher the number of laser light sources become, an increase in the phase difference between the intermediate transfer standard signal and the line synchronization signal is incurred. Thereby, the starting position of writing of the image in the sub-scanning direction is largely shifted. Consequently, a color shifting (the position shifting of the toner image of the respective colors) occurs and the quality of the color image deteriorates.

In an attempt to address this defect, there has been proposed a color image forming apparatus having a multiple-beam system in the Japanese Laid-open patent application 1998-239939. This color image forming apparatus includes compensation mechanisms configured to adjust the start position of writing images of respective color components in the sub-scanning direction and thereby compensating the color shift, by changing over the light beam by first writing the images of the respective colors on the photosensitive body among the plural light beams in accordance with a phase relationship between the phase of the intermediate transfer standard signal and that of the line synchronization signal.

However, with such a conventional color image forming device, speed unevenness occurs (a) to a photosensitive body and an intermediate transferring body by the contact or estrangement between a developing roller of the developing unit and a photosensitive body, and (b) between a transferring roller of a second transferring station and an intermediate transferring body. For this reason, a color shift may still occur in a sub-scanning direction.

SUMMARY OF THE INVENTION

The present invention was made in consideration of the above-mentioned problems, and it is an object of the present invention to solve those problems.

It is another object of the present invention to improve the correction accuracy of a color shift which is caused by a time lag between a synchronization signal and a mark signal and speed unevenness of a photosensitive body or an intermediate transferring body.

The present invention achieves the above-noted operation by providing a novel write controlling device, which for example can be used in a color image forming apparatus.

The novel write controlling device for an image forming apparatus includes a time lag detecting device and reconfiguration device. The time lag detecting device detects the time lag between the synchronization signal generated by a synchronization detecting means for defining the writing starting position in a main scanning direction and a mark signal generated by a mark sensor detecting the mark on an intermediate transfer belt configured to transfer the plural color toner components. A reconfiguration device is configured to transfer the plural color toner components. A reconfiguration device is configured to reconfigure a white line insertion value output by said time lag detecting device and a predetermined write timing setting value defining a writing start position in a sub-scanning direction according to a writing timing ancillary value for defining the quantity of reconfiguration.

According to another aspect of the invention, the write controlling device further includes a storage device configured to store the write timing setting value and the write timing ancillary value.

According to another aspect of the invention, the write controlling device further includes a rotation time detecting device configured to detect the rotation time of the transfer belt using a mark signal.

According to another aspect of the invention, the write timing ancillary value is selected based on speed fluctuations which are caused by attaching or detaching a photosensitive body having an electrostatic latent image and a developing member configured to develop the latent image.

According to another aspect of the invention, the write timing ancillary value is selected based on speed fluctuations which are caused by attaching or detaching the transfer belt and transfer member configured to transfer the plural color toner components to a sheet.

According to another aspect of the invention, a method is disclosed for forming an image. The method including the steps of: detecting a time lag between a synchronization signal corresponding to a write starting position in a main scanning direction and a mark signal corresponding to detection of a mark provided on a transfer belt; outputting a white line insertion value using the detected time lag; reconfiguring the white line insertion value and a write timing setting value defining a writing start position in a sub-scanning direction using a write timing ancillary value which defines a quantity of reconfiguration.

BRIEF DESCRIPTION OF THE DRAWINGS

A more complete application of the present invention and many of the attendant advantages thereof will be readily obtained as the same becomes better understood by reference to the following detailed description when considered in conjunction with the accompanying drawings, wherein:

FIG. 4 is a timing chart showing a relation between a mark signal output from a mark sensor shown in FIG. 2 and a synchronization signal output from a synchronization detecting device shown in FIG. 3.

FIG. 5 is an explanatory diagram showing a write timing in the sub-scanning direction of the multiple beam scanning unit shown in FIG. 2.

FIG. 6 is a timing chart showing a relation between a mark signal output from a mark sensor shown in FIG. 2, a synchronization signal output from a synchronization detecting device shown in FIG. 3, and a frame gate signal (hereinafter referred to as "the FGATE signal).

DESCRIPTION OF THE PREFERRED EMBODIMENT

Figure 2:
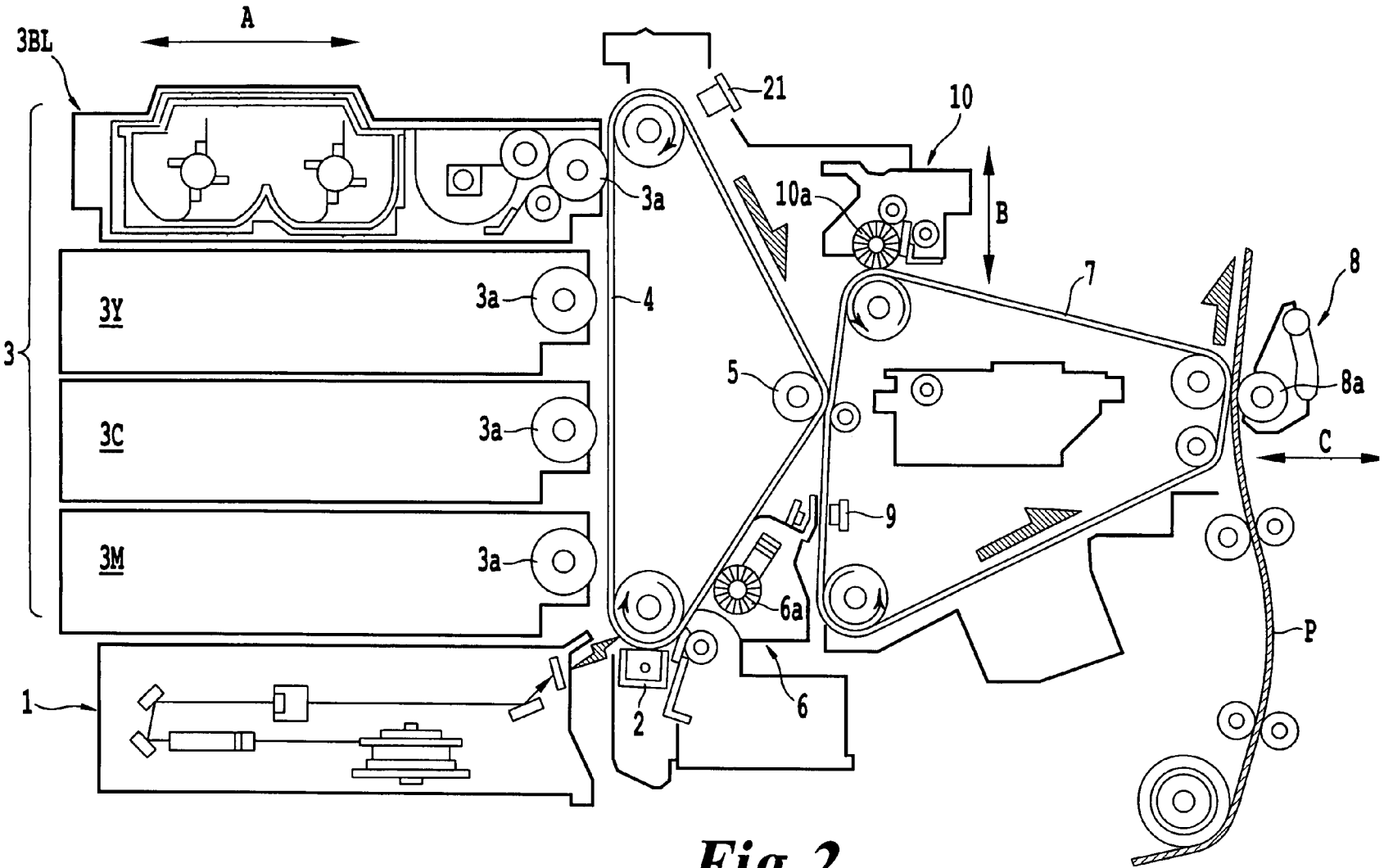
FIG. 2 is an explanatory diagram showing a mechanism of the color laser printer.

Referring now to the drawings, wherein like reference numerals designate identical or corresponding parts throughout the several views, and more particularly to FIG. 2 thereof, where there is illustrated an appearance of a main structure of the above-mentioned color laser printer functioning as an image forming apparatus.

Figure 11:
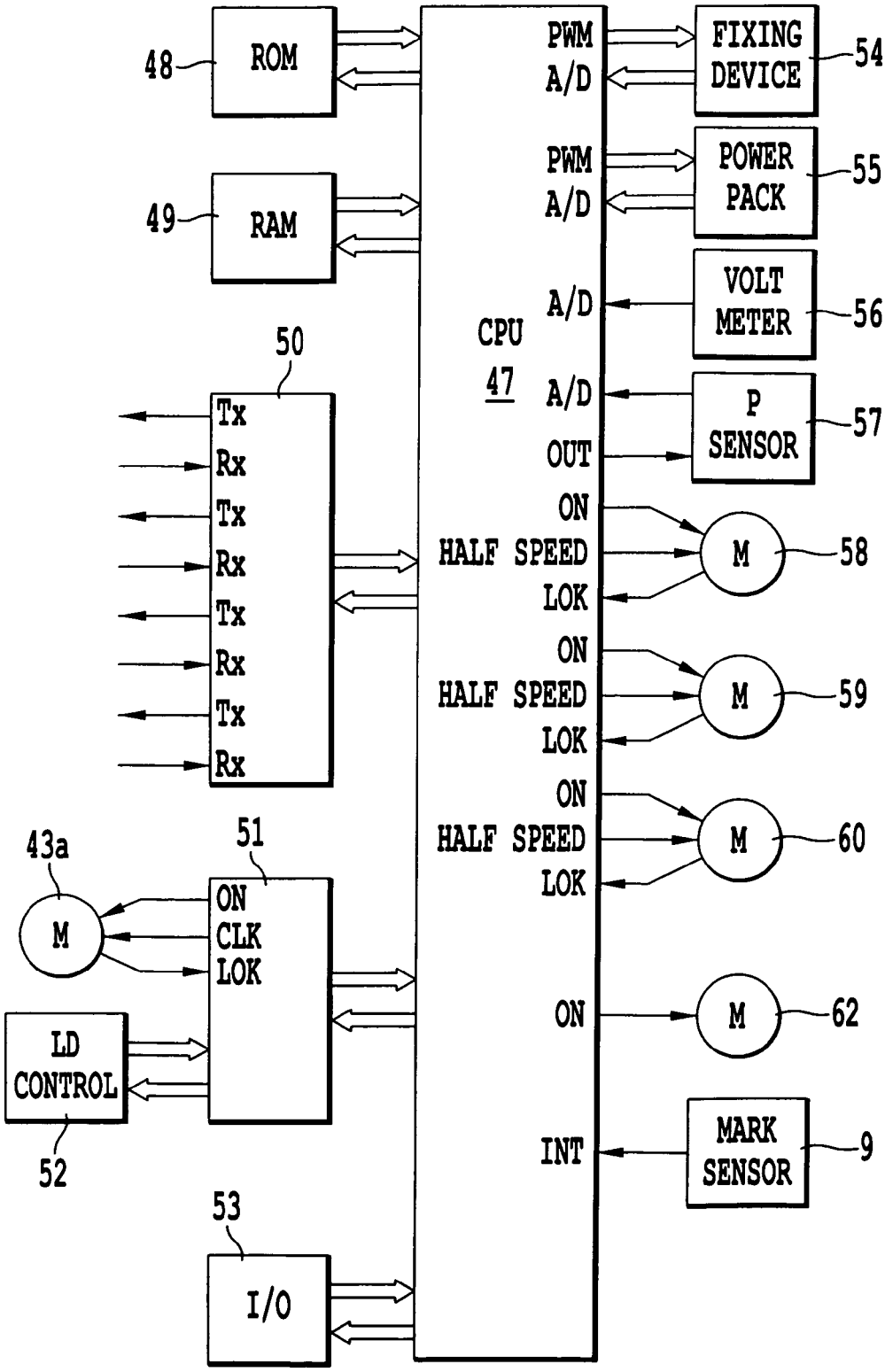
FIG. 11 is a block diagram showing a control section of the above-mentioned color laser printer according to the present invention.

The color laser printer receives data such as a character code, etc. from a personal computer, for example, and modifies the data into image data (image information) in units of a page by using an image processing unit 51 shown in FIG. 11. The image data is sent to an LD control unit 52 configured to emit light using laser unit 11.

The color laser printer includes a photosensitive body 4, a developing unit 3, an intermediate transfer belt 7 employed as the intermediate transfer body, and a multiple beam scanning unit 1 functioning as the light-exposing mechanism. Although a photosensitive belt 4 is used in one embodiment as the photosensitive body 11, a photosensitive drum can also be used instead of the photosensitive belt 4. Furthermore, instead of the intermediate transfer belt 13, another type of intermediate transfer body such as an intermediate transfer drum, an intermediate transfer roller, or the like can also be used.

As shown in FIG. 2, around the photosensitive body 4 there are arranged a charging charger 2 employed as a charging mechanism configured to uniformly charge the photosensitive body 4, a photo-sensor 21 (hereinafter, called "P-sensor") employed as a density detecting mechanism configured to optically detect the amount of attached toner (toner density) on the photosensitive body 4, a primary transfer roller 5 employed as a transfer mechanism configured to transfer the toner image formed on the photosensitive body 11 onto the intermediate transfer belt 7, a primary cleaning unit 6 including a cleaning brush 6*a*, and a charge removing mechanism configured to remove the charge on the photosensitive body (which is not illustrated).

The intermediate transfer belt 7 is provided around the plural rollers. A predetermined roller among those rollers is driven by a drum motor and the intermediate transfer belt 4 consequently rotates.

In the inside of the intermediate transfer belt 7 there are provided plural standard marks employed as standard reference points for positioning the toner images of the respective colors at the time of the image superposing when transferring the respective color toner images on the photosensitive body 4 onto the intermediate transfer belt 7 per each of the respective picture planes. Near the intermediate transfer belt 7, there are arranged, along the belt 7 in the rotational direction thereof, a mark sensor 9 employed as a mark detecting mechanism configured to detect the standard marks on the intermediate transfer belt 7.

The secondary cleaning device 10 is constructed with, for example, a cleaning member including a cleaning brush 10*a*. The secondary cleaning device 10 is attached to or detached from the intermediate belt 7 in accordance with the ON/OFF operation of a solenoid for attaching/detaching the secondary cleaning device 10. When the secondary cleaning device 10 is brought into direct contact with the intermediate transfer belt 7, the toner on the intermediate belt 7 is removed therefrom.

The secondary transfer device 8 having a secondary transfer roller 8*a* can be attached to and detached from the intermediate transfer belt 7 in accordance with the ON-OFF operation of the secondary transfer device solenoid.

In the conveying path for conveying the transfer sheet, a registration roller is disposed at the upstream side of the secondary transfer device 8. A fixing apparatus having a fixing roller and a pressurizing roller brought into pressed contact with the fixing roller is disposed at the downstream side of the secondary transfer device 8.

The multiple beam scanning unit 1 constitutes a multiple beam scanning means having a laser diode unit 11 (hereinafter referred to as "LD unit") and emits a plurality of light beams depending on the image data of plural lines by driving the LD unit. The multiple beam scanning unit 1 writes the electrostatic latent image on the photosensitive body 4 rotating in the sub-scanning direction by repeatedly scanning in the main scanning direction which is orthogonal to the sub-scanning direction.

The developing unit 3 holds a plurality of developing devices (3BL, 3Y, 3C, and 3M) configured to develop the electrostatic latent images of the respective colors formed on the photosensitive body 4 and converts the latent images to the toner images of the respective colors. For instance, the developing unit 3 holds a developing apparatus 3BL configured to develop the electrostatic latent image on the photosensitive body 4, so as to obtain a black toner image, a developing device 3Y configured to develop the electrostatic latent image on the photosensitive body 4, so as to obtain a yellow toner image, a developing device 3C configured to develop the electrostatic latent image on the photosensitive body 4, so as to obtain a cyan toner image, and a developing device 3M configured to develop the electrostatic body 4, so as to obtain a magenta toner image.

Each of the developing units 3 is attached to or detached from the photosensitive body 4 in accordance with the ON/OFF operation of a solenoid for attaching/detaching each of the developing units 3. After a color toner image is formed on the photosensitive body 4, the developing unit corresponding to the color formed on the photosensitive body 4 is detached from it.

When an image data received by an engine driver (this includes a CPU 47 shown in FIG. 11) includes color data for making a full color image, the multiple beam unit 1 and the developing unit 3 carry out the following steps.

First, the multiple beam unit 1 writes, according to the magenta color data, the magenta color latent image on the photosensitive body 4. When the front edge of the magenta color latent image comes to the position of the developing portion of the developing unit 3M, the developing roller 3*a* attaches to the photosensitive body 4 to start developing the magenta color latent image, and when the posterior edge of the magenta latent image passes through the development position, the developing unit 3M stops developing, and the developing unit 3M is detached from the photosensitive body 4. Herewith, the magenta toner image is formed on the photosensitive body 4. Then, the magenta toner image is transferred to the intermediate transfer belt 7 by the primary transfer roller 5. After the magenta toner image is transferred to the intermediate transfer belt 7, the magenta toners remaining on the photosensitive body 4 are cleaned by cleaning brush 6*a* of the primary cleaning unit 6, and electric charges on the photosensitive body 4 are removed by a removing lamp not shown in FIG. 2.

The above-mentioned cycle regarding the magenta toner including charging of the photosensitive body 4, developing the toner image by the developing unit 3, transferring to the intermediate transfer belt 7, cleaning the photosensitive body using primary cleaning unit 6, and removing the electric charges from the photosensitive body is repeated for each color of the color image data.

A toner image of each color sequentially formed on the photosensitive body 4 is sequentially transferred to intermediate transfer belt 7. Consequently, a toner image of a four colored stack is formed on the intermediate transfer belt 7. This toner image of a four-colored stack is transferred as one image to the transfer sheet P fed from a paper feed unit (not shown) by using the secondary transfer roller 8*a* of the secondary transfer device 8.

In such occasions, when a progression for forming the magenta toner image on the intermediate transfer belt 7 (hereinafter, called "M-progression") is over, a C-progression (that is a progression for forming the cyan toner image to the intermediate transfer belt 7) is advanced to. Therefore, the write starting timing of the cyan image data (an output timing of the cyan image data) is adjusted so that the front edge of the cyan toner image is in accordance with the front edge of the magenta toner image on the intermediate transfer belt 7. At this time, plural standard marks located at even intervals on the internal side of the intermediate transfer belt 7 along the circumferential direction at even intervals are detected by mark sensor 9 (this sensor is employed as rotation position detecting means). A sub-scanning reference signal based on the output signal of the mark sensor 9 is generated and the multiple beam scanning unit 1 starts optical writing of the cyan latent image when a predetermined time is measured from generating the sub-scanning reference signal.

In the same way, a Y-progression (that is a progression for forming the yellow toner image to the intermediate transfer belt 7) and a BL-progression (that is a progression for forming the black toner image to the intermediate transfer belt 7) are executed. Consequently, a toner image of a four-colored stack is formed on the intermediate transfer belt 7. However, the procedure for making the four-colored stack image is not limited to the above described order (magenta, cyan, yellow, black). The order is determined based on the toner's peculiarity, and the finish state of the color image on a paper sheet.

The transfer sheet P having the four-colored stack image which is transferred by the secondary roller 8*a* is conveyed to the fixing unit (not shown) and the four colored stack image is fixed to the transfer sheet P. After the four-colored stack image is transferred by the secondary roller 8*a*, the secondary roller 8*a* is detached from the intermediate transfer belt 7. After that, the secondary cleaning brush 10*a* of the secondary cleaning unit 10 is attached to the intermediate transfer belt 7, and the remaining toners are carried away by the secondary cleaning brush 10*a*. The secondary cleaning brush 10*a* is detached from the intermediate transfer belt 7 after the cleaning of the toners.

Figure 3:
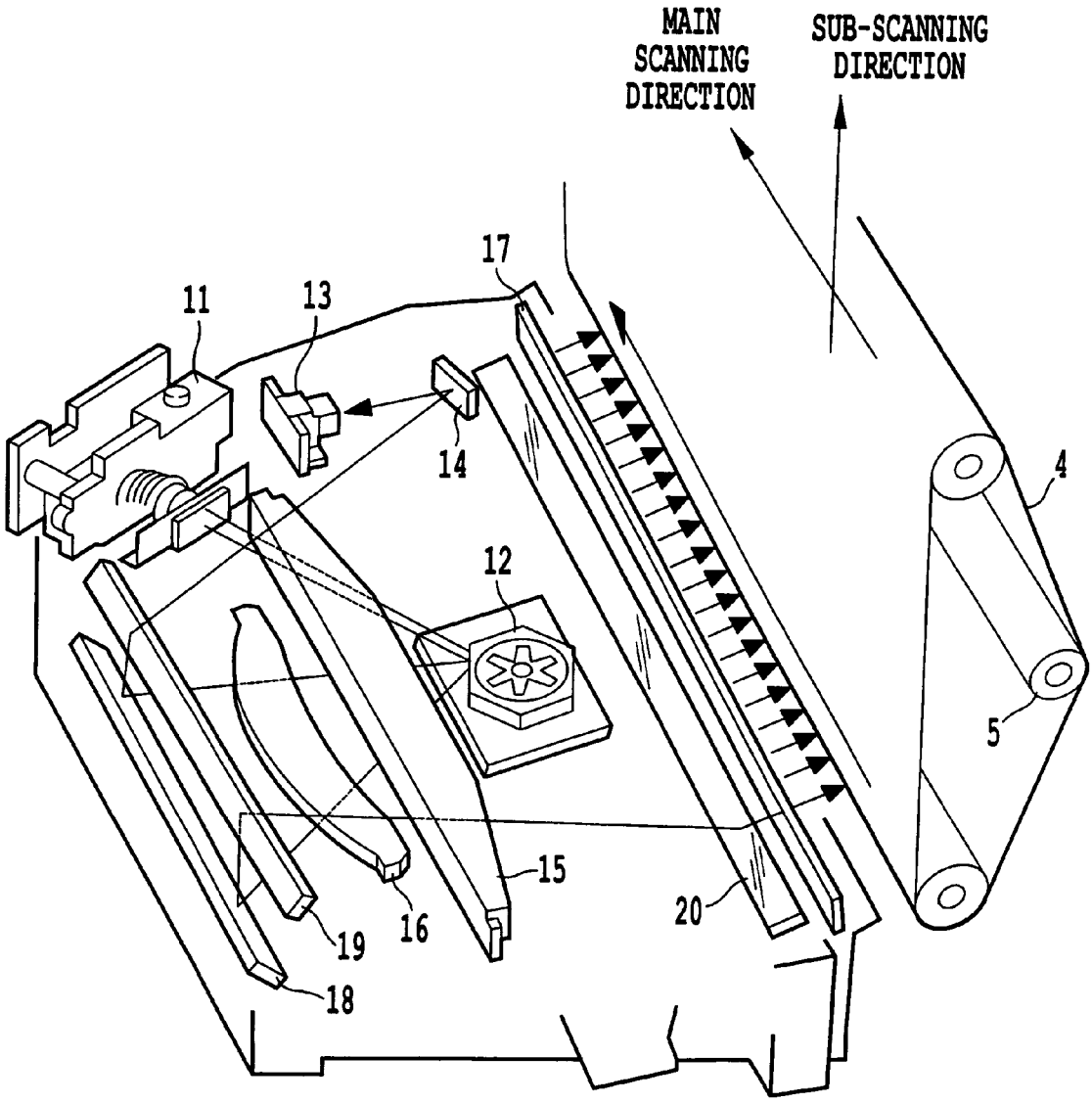
FIG. 3 is a perspective view showing an optical scanning system including a multiple beam scanning unit of the color laser printer shown in FIG. 2.

FIG. 3 shows an optical scanning system of the aforementioned multiple beam scanning unit 1. In the multiple beam scanning unit 1, a plurality of light beams are emitted from the LD unit 11 for emitting the light beam, composed of the plural laser beams (hereinafter referred to as "beam"), and are directed as incident light rays onto a rotatable polygon mirror 12 through the collimating lens 15. The respective beams directed as incident light rays onto the polygon mirror 12 are scanned as a result of a rotational action of the polygon mirror 12. The surface of the photosensitive body 4 is also scanned by being exposed with the light rays simultaneously in the main scanning direction with the beam pitch of the sub-scanning direction by use of an optical scanning system composed of an f-theta lens 16, a troidal lens 15, etc. and tuning-up mirrors 18, 19 for folding back the beams.

The polygon mirror 12 is driven by a polygon motor (not shown). A synchronization detecting device 13 functioning as a line synchronization signal generating mechanism shown in FIG. 3 detects the beams from the reflecting mirror 14 for synchronization detecting at a predetermined position excluding the writing area on the photosensitive body 4.

The synchronization detecting device detects the plural light beams directed as the incident light rays from the LD unit 11 through the collimating lens 14, the polygon mirror 12, the f-theta lens 16, and the troidal lens 15, and outputs one output signal for the plural light beams as the synchronization signal. The synchronization detecting device includes a photoelectric transducer such as a photodiode, and a wave-shaping circuit.

The synchronization signal is used for deciding the write timing in the main scanning direction. Therefore, the synchronization detecting device constitutes a main scanning reference timing detecting means.

In such a structure, the LD unit 11, usually emits plural light beams modulated in accordance with the image signal by driving four light sources, for example, four semiconductor devices.

FIG. 11 shows the control section of the above-mentioned color printer. A CPU 47 executes the processing of the operational calculation, etc., in accordance with the contents of a control program. A ROM 48 stores the control program therein. A RAM 49 is employed for storing the data therein (and losing the data upon loss of power). The CPU 47, the ROM 48 and the RAM 49 are connected to each other by use of a data bus or an address bus. A serial communication controller 50 performs the operations of transmitting/receiving command signals exchanged between the control section of the above-mentioned scanner and the CPU 47. The serial communication controller 50 is connected to the CPU 47 by use of the data bus and the address bus.

An image processing unit 51 configured to perform the light exposure control for the photosensitive body 11 is connected to the CPU 47 by use of the data bus and the address bus, and is further connected to a light-exposing LD control unit 52 and the above-mentioned polygon motor 43*a* and controls the light exposing LD control unit 52 and the polygon motor 43*a*. The light-exposing LD control unit 52 performs the operation of turning-on control for LD 41*a* and LD 41*b* in the writing apparatus 14 in accordance with the input signal from the image processing controller. An I/O controller 53 performs the input/output control for the CPU 47. The control section of the color printer is constructed with the CPU 47, the ROM 48, the RAM 49, the serial communication controller 50, the image processing unit 51, the light-exposing LD control unit 52, and the I/O controller 53.

A fixing unit 54 includes a fixing thermistor configured to detect the surface temperature of the above-mentioned fixing roller. The CPU 47 performs the A/D conversion of the temperature detection signal of the fixing thermistor and outputs the pulse width modulation (PWM) pulse signal on the basis of the value of the A/D conversion. In such a structure, the ON/OFF control is performed for a fixing heater and consequently the surface of the fixing roller is controlled so as to keep the temperature constant.

The CPU 47 performs the A/D conversion of the output voltage fed back from the power pack unit 55, and outputs the PWM signal to the power pack unit 55 on the basis of the value of the A/D conversion and controls the output voltage of the power pack unit 55.

An electric potential meter circuit 56 including an electric potential meter detects the surface potential of the photosensitive body 4. The output signal of the electric potential is input to the A/D input terminal of the CPU 47. The P sensor circuit 57 including the P sensor 21 includes a light emission diode and a phototransistor, and is configured to optically detect the amount of attached toner (density) on the photosensitive body. The photo-transistor output signal of the P sensor 21 is input to the A/D input terminal. The CPU 47 outputs the PWM pulse to the light emission diode driving circuit in the P sensor 21.

The above-mentioned main motor 58 rotatively drives the transfer material conveying system configured to convey the transfer material. The above-mentioned drum motor 59 rotatively drives the photosensitive body 4 and the intermediate transfer belt 7. The developing motors 60 rotatively drive the developing rollers in the developing units 3BL, 3Y, 3C, 3M, respectively. The ON signal, the half speed signal for reducing the speed to half (½), and the lock signal for deciding whether the speed has reached the targeted speed are respectively input from the CPU 47 to those motors.

A toner replenishing motor 62 replenishes the respective color toners of black, cyan, magenta and yellow into the developing unit 3 from the respective toner cartridges. The CPU 47 controls the turn-on timing of the toner replenishing motor in accordance with the amount of the attached toners of the respective colors: black, cyan, magenta and yellow on the basis of the input signal from the P sensor 21. The output signal of the mark sensor 9 is input to the thrusting terminal of the CPU 47 because of the required timing accuracy.

FIG. 4 is a timing chart showing a relation between a mark signal output from a mark sensor shown in FIG. 2 and a synchronization signal output from a synchronization detecting device shown in FIG. 3.

As shown in FIG. 4, a phase lag between the mark signal and the synchronization signal occurs because the mark signal generated by the mark sensor 9 is not synchronized with the synchronization signal. This means that the mark sensor 9 detected each of the plural marks after one cycle of the intermediate transfer belt 7. Thus, because the mark detection is produced more than once, one of those mark signals can be used to generate the sub-scanning reference signal.

FIG. 5 is an explanatory diagram showing a write timing in the sub-scanning direction of the multiple beam scanning unit shown in FIG. 2. In this case, the LD unit 11 has four laser diodes, and generates four beams. As a consequence of one beam's scan in the main scanning direction, the latent image of one line is formed on the photosensitive body 4. Therefore, in this embodiment, four lines of latent images can be formed on the photosensitive body 4 simultaneously. No color toner image on the photosensitive body 4 is formed by using white data.

Four data patterns which are used to start the writing of the four beams are illustrated in FIG. 5. When the write timing of the all lines are simultaneously, a writing start position in the sub-scanning direction can be changed by insertion of, for one line, white data to a predetermined main scanning line at the writing start timing. This means, if the number of white data lines is changed, the writing start timing is changed. Therefore, by inserting one line unit, an image forming position in a sub-scan direction can be changed. As shown in FIG. 4, for example, if there are phase shifts shown as A or B (A' or B'), the number of white lines corresponding to the length of the phase shifts can be added.

FIG. 6 is a timing chart showing a relationship between a mark signal output from a mark sensor, a synchronization signal output from a synchronization detecting device, and an FGATE signal. The FGATE signal defines an effective range of an image data in the sub-scanning direction. The FGATE signal synchronizes to a synchronization signal. The C time shown in FIG. 6 is determined based on the writing start position in the sub-scanning direction and starts when the first synchronization signal asserted in a low level interval of the mark signal (a low active signal) is made. Consequently, the C time is different in each apparatus.

Figure 1:
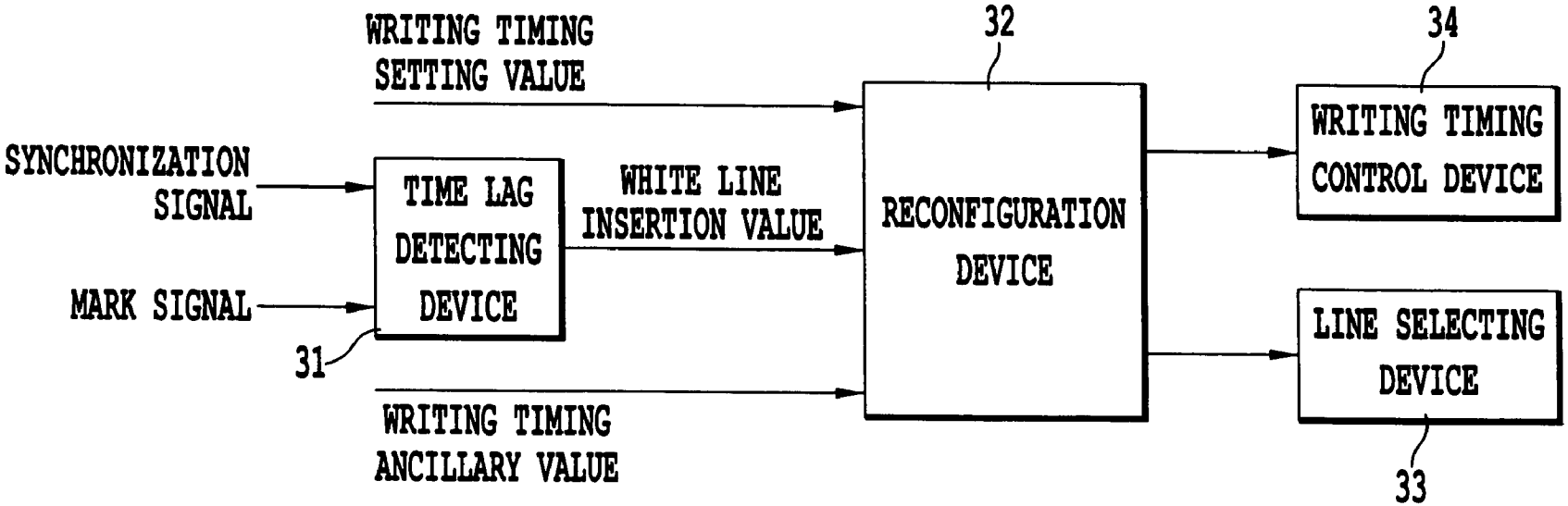
FIG. 1 is a block diagram showing a constitution of a writing control unit of the first embodiment in a color laser printer shown in FIG. 2.

FIG. 1 is a block diagram showing a constitution of part of a writing control unit using the reconfiguration device of the first embodiment. The writing control unit belongs to the LD control unit 52.

The time lag detecting device 31 determines a time lag between an input of the synchronization signal and an input of the mark signal. This determined time lag is based on the phase lag between the synchronization signal and the mark signal. Based on the determination of the time lag detecting device, the number of white lines to be inserted is decided. time lag detecting device 31 outputs the number of white lines (see FIG. 5) to the reconfiguration device 32.

In the situation where a write timing setting value and a write timing ancillary value are input to the reconfiguration device, when the white line insertion value is input by the time lag detecting device 31, the reconfiguration device reconfigures the write timing setting value and the white line insertion value. Next, the reconfiguration device outputs, in accordance with the values shown in Table 1, the reconfigured write timing setting value to the writing timing control device 34, and outputs the reconfigured white line insertion value to the line selecting device 33.

TABLE 1

| | | WHITE LINE INSERTION VALUE | | | |
|---|---|---|---|---|---|
| | | 0 | 1 | 2 | 3 |
| WRITING TIMING ANCILLARY VALUE | 0 | WHITE LINE 0 TIMING 0 | WHITE LINE 1 TIMING 0 | WHITE LINE 2 TIMING 0 | WHITE LINE 3 TIMING 0 |
| | 1 | WHITE LINE 1 TIMING 0 | WHITE LINE 2 TIMING 0 | WHITE LINE 3 TIMING 0 | WHITE LINE 0 TIMING 1 |
| | 2 | WHITE LINE 2 TIMING 0 | WHITE LINE 3 TIMING 0 | WHITE LINE 0 TIMING 1 | WHITE LINE 1 TIMING 1 |
| | 3 | WHITE LINE 3 TIMING 0 | WHITE LINE 0 TIMING 1 | WHITE LINE 1 TIMING 1 | WHITE LINE 2 TIMING 1 |

In the Table 1, "white line 0" means a reconfigured white insertion value is 0, "white line 1" means a reconfigured white insertion value is 1, "white line 2" means a reconfigured white insertion value is 2, and, "white line 3" means a reconfigured white insertion value is 3. When the reconfigured white insertion value is 0, a white line is not inserted at the write start timing. When the reconfigured white insertion value is 1, one white line is inserted at the write timing. When the reconfigured white insertion value is 2, two white lines are inserted at the write timing. When the reconfigured white insertion value is 3, three white lines are inserted at the write timing. These insertion patterns are illustrated in FIG. 5 discussed above.

In the Table 1, "timing 0" or "timing 1" indicates a reconfigured write timing setting value. Furthermore, in the Table 1, "timing 0" means that the previous write timing setting value is maintained after the reconfiguration, and "timing 1" means that the delay time for one period is added to the time which is indicated by the previous write timing setting value after the reconfiguration. Here, though the delay time for one period is added by "timing 1", two periods, in lieu of one period, can be added by "timing 1".

Fluctuating speed occurs because of the attaching or detaching between the developing roller 3*a* and the photosensitive body 4, the intermediate transfer belt 7 and the secondary transfer roller 8*a*, or the intermediate transfer belt 7 and the secondary cleaning brush. Though the write timing is delayed, the write timing can be carried forward. In this case, a value corresponding to a progress time is subtracted from the previous write timing setting value.

The line selecting device 33 constitutes the line selecting means, and defines the writing start line in the sub-scanning direction regarding the four beams according to the white line insertion value which is input from the reconfiguration device 32. The details of the controlling process are identical to the control process of FIG. 5.

The write timing control device 34 constitutes the write timing control means, and controls the writing start timing in the sub-scanning direction according to the reconfigured write timing setting value which is input from the reconfiguration device 32.

According to the writing control unit shown in FIG. 1, the color shift corresponding to the speed fluctuations discussed above is reduced, and the quality of the images are improved.

Figure 7:
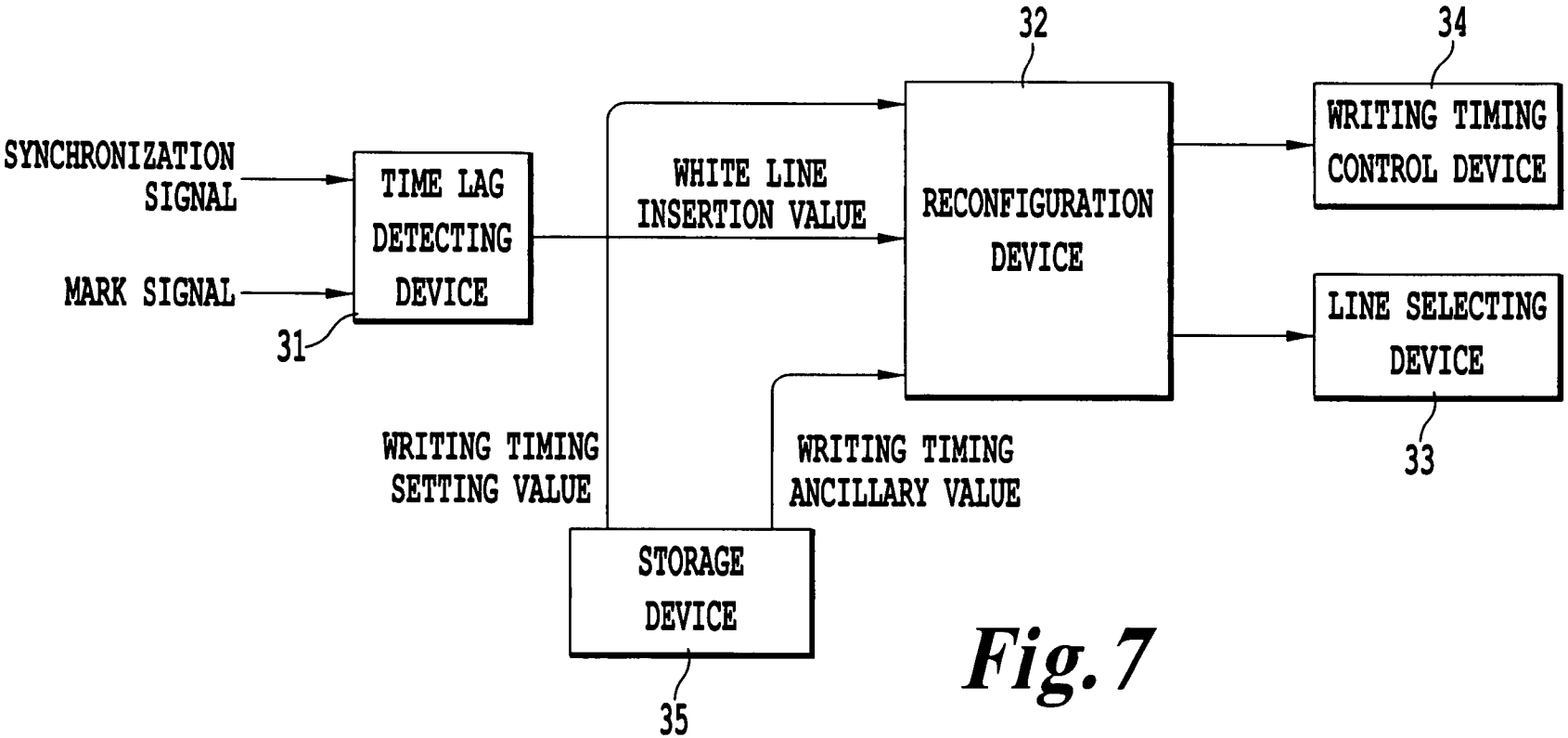
FIG. 7 is a block diagram showing a constitution of a write control unit of the second embodiment in a color laser printer shown in FIG. 2.

FIG. 7 is a block diagram showing a constitution of part of a writing control unit of the second embodiment. The elements illustrated in FIG. 7 which are identical to the elements illustrated in FIG. 1 are not described again here.

The writing control unit shown in FIG. 7 includes a storage device 35, in contrast to the writing control unit shown in FIG. 1. The contents written in the storage device 35 are shown in Table 2. Each of the setting value combinations in Table 2 reflect the write timing value and write timing ancillary value.

TABLE 2

| | FIRST PAGE | AFTER THE SECOND PAGE | FINAL PAGE |
|---|---|---|---|
| BLACK | SETTING VALUE B-1 | SETTING VALUE B-2 | SETTING VALUE B-3 |
| MAGENTA | SETTING VALUE M-1 | SETTING VALUE M-2 | SETTING VALUE M-3 |
| CYAN | SETTING VALUE C-1 | SETTING VALUE C-2 | SETTING VALUE C-3 |
| YELLOW | SETTING VALUE Y-1 | SETTING VALUE Y-2 | SETTING VALUE Y-3 |

The storage device 35 constitutes the storage means and can be for example RAM or other comparable memory. The write timing value and the write timing ancillary value in Table 2 are optimum values, and each of the optimum values is defined according to the combination between the color to be developed and the type of print page. Each optimum value is selected based on empirical data. The reconfiguration device 32 reads out the write timing setting value and the write timing ancillary value from the storage device 35 in accordance with the color of the toner to be used and each print page. The operation of the reconfiguration device 32 in FIG. 7 is identical with the device shown in FIG. 1.

According to the writing control unit shown in FIG. 7, because the storage device 35 stores the optimum value, the color shift corresponding to the speed fluctuations discussed above is relatively smaller, and the quality of the images are improved.

Figure 8:
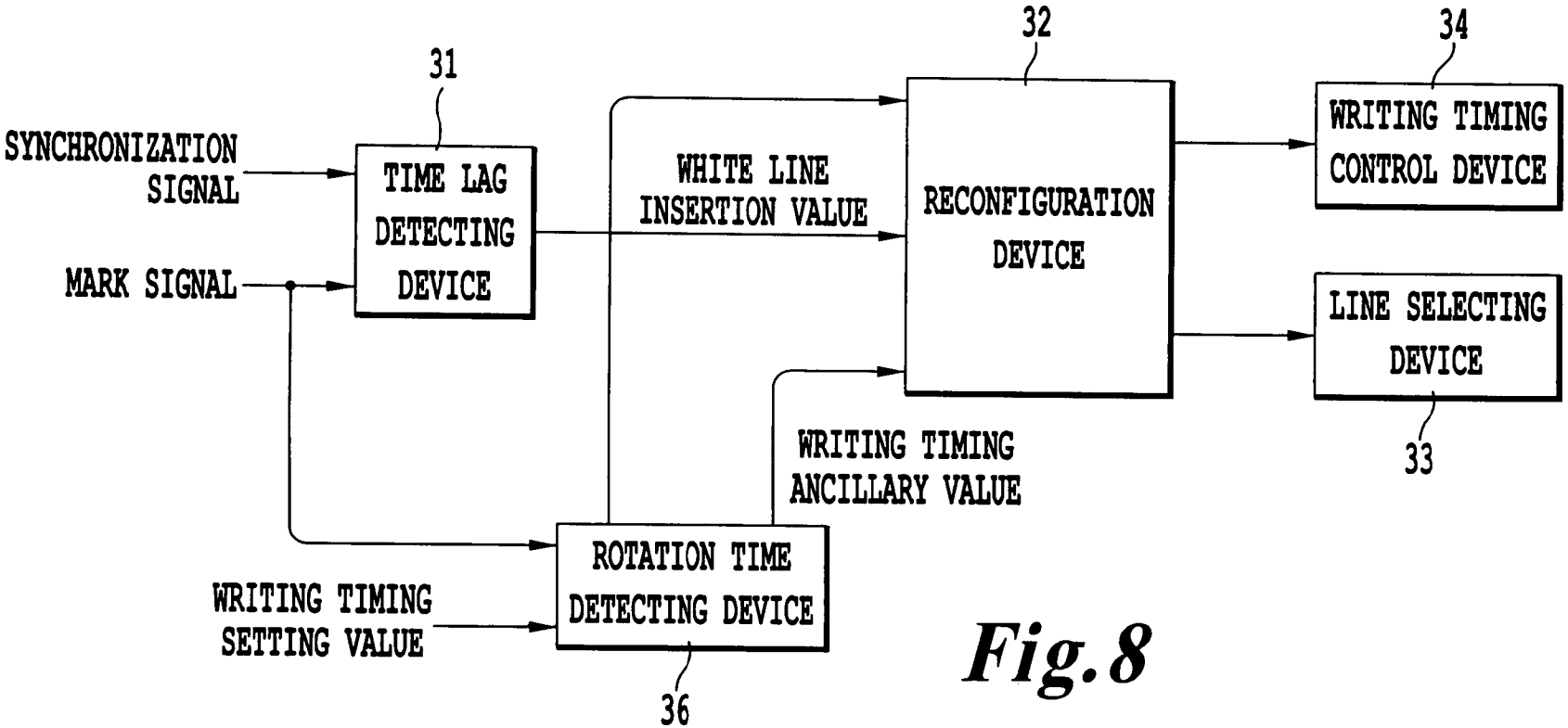
FIG. 8 is a block diagram showing a constitution of a write control unit of the third embodiment in a color laser printer shown in FIG. 2.

FIG. 8 is a block diagram showing a constitution of part of a writing control unit of the third embodiment. The elements in FIG. 8 which are identical to the elements in FIG. 1 are not described again here.

The writing control unit shown in FIG. 7 includes a rotation time detecting device 36 in contrast to the writing control unit shown in FIG. 1.

The rotation time detecting device 36 constitutes a rotation time detecting means. The rotation time detecting device 36 determines the rotation time of the intermediate transfer belt by detecting a mark provided on the belt. Further, the rotation time detecting device 36 modifies the write timing setting value and the ancillary write timing setting value based on the outcome of the detection before inputting those values to the reconfiguration device 32.

The reconfiguration device receives the write timing setting value and the modified write timing setting value, and reconfigures those values according to the speed fluctuations that come from the attaching or detaching of units. However, the rotation time detecting device 3 can modify either the write timing setting value or the write timing ancillary value.

The operation of the reconfiguration device 32 illustrated in FIG. 8 is identical to the operation of the same device shown in FIG. 1. Here, however, the rotation time detecting device 36 is explained in more detail.

Figure 9:
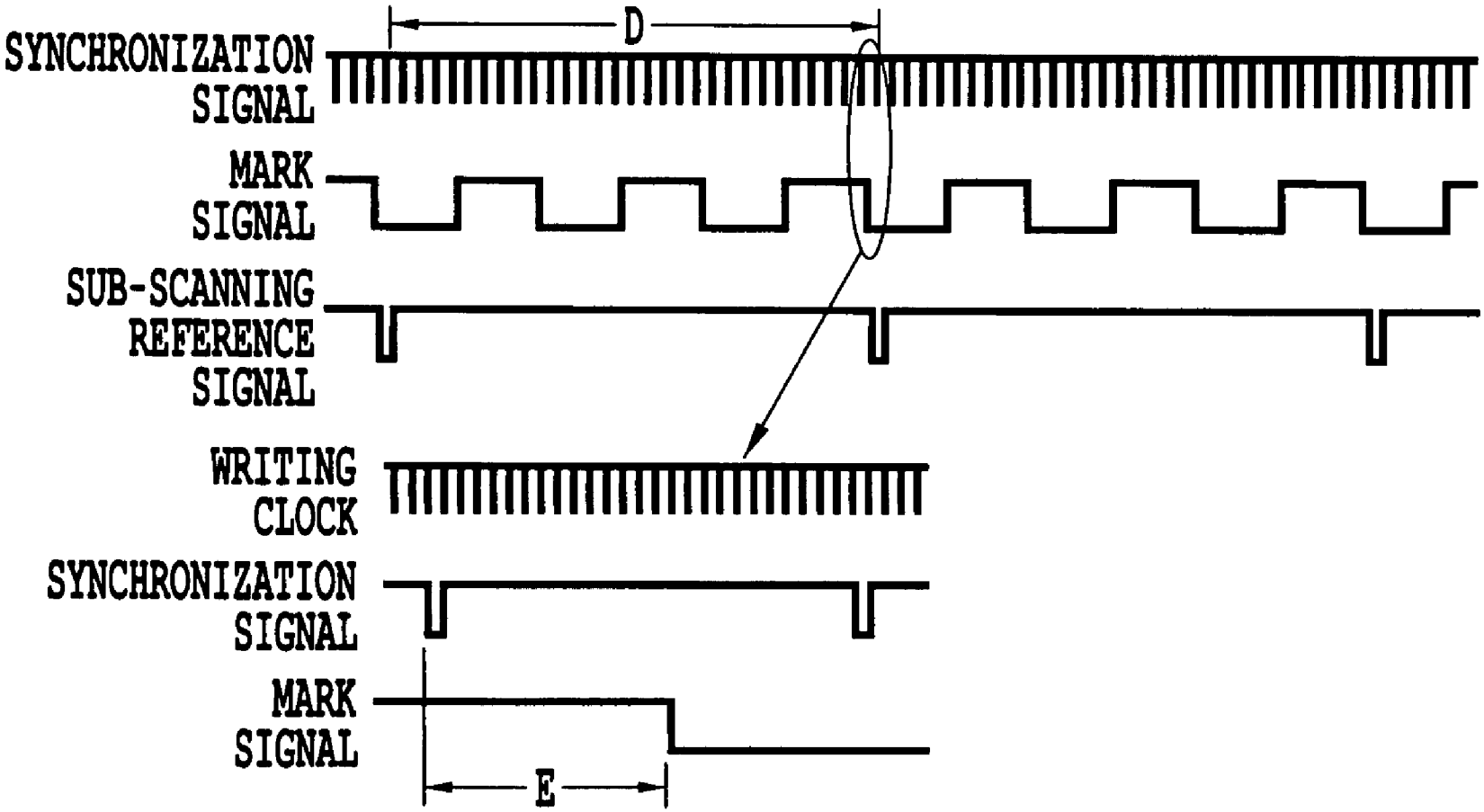
FIG. 9 is a timing chart showing a relation between a mark signal output from a mark sensor shown in FIG. 2, a synchronization signal output from a synchronization detecting device shown in FIG. 3, and a sub-scanning reference signal.

FIG. 9 is a timing chart showing a relationship between the mark signal output from a mark sensor 9, the synchronization signal output from a synchronization detecting device 13, and the sub-scanning reference signal.

The image processing controller 51 illustrated in FIG. 11 forms a part of the rotation time detecting device 36. The rotation time detecting device 36 determines a time between the two falling edges in the sub-scanning reference signal, and counts the rotation time of the intermediate transfer belt 7.

The sub-scanning reference signal is used to position the image on the intermediate transfer belt 7 in the sub-scanning direction. The sub-scanning reference signal is also used to generate the falling edge of the FGATE signal (i.e., low active signal).

The rotation time detecting device 36 determines a time D from a falling edge to the next falling edge of the sub-scanning reference signal synchronized with the synchronization signal. Furthermore, the rotation time detecting device 36 determines a time E between the falling edge of the synchronization signal and the falling edge of the mark signal using the writing clock.

The rotation time detecting device 36 adds the time E to the time D. Consequently, the rotation time detecting device 36 obtains the rotation time of the intermediate transfer belt 7. The rotation time detecting device 36 compares the sum of the time D and the time E to a predetermined reference time (for instance, an average time obtained in advance), and modifies the write timing setting value and the write timing ancillary value. The rotation time detecting device 36 can modify either the write timing setting value or the write timing ancillary value.

According to the writing control unit shown in FIG. 8, because the rotation time detecting device 36 modifies the write timing setting value and the write timing ancillary value in accordance with the rotation time of the intermediate transfer belt 7, the color shift corresponding to the speed fluctuation discussed above is reduced, and the quality of the images are improved.

Figure 10:
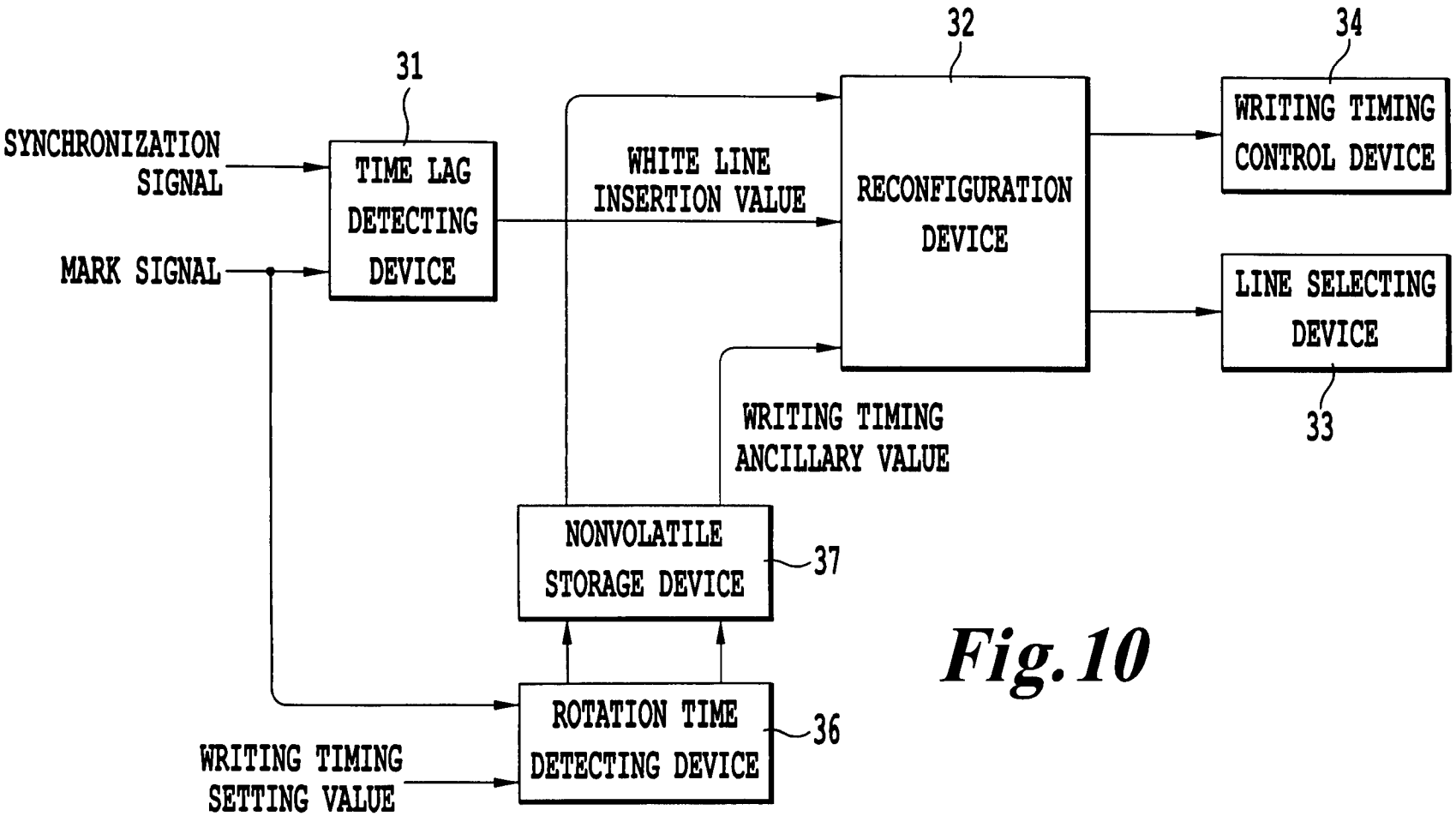
FIG. 10 is a block diagram showing a constitution of a writing control unit of the fourth embodiment in a color laser printer shown in FIG. 2.

FIG. 10 is a block diagram showing a constitution of part of a writing control unit of the fourth embodiment. The elements in FIG. 10 which are identical to the elements illustrated in FIG. 8 are not described again here.

The writing control unit shown in FIG. 7 has the rotation time detecting device 36 and a nonvolatile storage device 37 in contrast to the writing control unit shown in FIG. 1.

The nonvolatile storage device 37 is a nonvolatile storage means such as a flash ROM or a hard disc. The nonvolatile storage device 37 stores the write timing setting value and the write timing ancillary value which are modified by the rotation time detecting device 36. The nonvolatile storage device 37 can store either the writing timing setting value or the writing timing ancillary value.

In the writing controller unit above mentioned, the reconfiguration device 32 reconfigures the white line insertion value and the writing timing setting value in accordance with the write timing setting value and the write timing ancillary value stored in the nonvolatile storage device 37, and the white line insertion value from the time lag detecting device 31 immediately after startup. Further, the reconfiguration device 32 reconfigures the white line insertion value and the write timing setting value in accordance with the modified write timing setting value and the write timing ancillary value from the nonvolatile storage device 37, and the white line insertion from the time lag detecting device 31. Thus, the color laser printer can dynamically adjust to the environmental variations or moment-to-moment changes.

According to the writing control unit shown in FIG. 10, because the nonvolatile storage device 37 stores the modified write timing setting value and the write timing ancillary value from the rotation time detecting device 36, the color shift corresponding to speed fluctuations discussed above is reduced, and the quality of the images are enhanced.

Furthermore, although the present invention can be used for a color laser printer, for example, a copier, a facsimile or a multifunction peripheral (multifunction printer). The multifunction peripheral has plural functions selected from a copier function, a facsimile function, a printer function, and a scanner function.

As discussed above, the push button mechanism of the present invention is suitable to function as the electrical contact. Further, the operation panel of the present invention is suitable to input a command to an image forming apparatus. Furthermore, the image forming apparatus of the present invention is suitable to form an image according to the command from the operation panel.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuit or by interconnecting an appropriate network of conventional components, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed is:

1. A write controlling device for an image forming apparatus comprising:

a time lag detecting device configured (i) to detect a time lag between (a) synchronization signal generated by a synchronization detecting device and (b) a mark signal generated by a mark sensor configured to detect a mark on a transfer belt configured to transfer plural color toner components; and (ii) to output a white line insertion value using the detected time lag, the white line insertion value reflecting the number of white lines to be inserted;

a reconfiguration device configured to reconfigure the white line insertion value and a write timing setting value defining a writing start position in a sub-scanning direction using a write timing ancillary value which defines the quantity of reconfiguration; and a storage device configured to store said write timing setting value and said write timing ancillary value;

wherein the storage device stores a plurality of write timing ancillary values, the write timing ancillary values are associated with a color and a page position where the color toner component will be transferred, respectively, and the page position is a first page, a last page, or an intervening page.

2. A color image forming apparatus comprising:

a multiple beam scanning unit including a light beam emitting device configured to emit plural light beams and a synchronization detecting device configured to generate a synchronization signal defining a write starting position in a main scanning direction;

a photosensitive body configured to have sequentially formed thereon, plural latent image color components of an electrostatic latent image by scanning the plural light beams across said photosensitive body while moving said photosensitive body in a sub-scanning direction;

a developing member configured to develop the plural latent image color components;

an intermediate transferring body configured to transfer the plural color toner image components to a sheet;

a time lag detecting device configured (a) to detect a time lag between the synchronization signal and a mark signal generated by a mark sensor configured to detect a mark formed on the intermediate transfer belt, and (b) output a white line insertion value, the white line insertion value reflecting the number of white lines to be inserted;

a reconfiguration device configured to reconfigure the white line insertion value and a write timing setting value defining a writing start position in sub-scanning direction using a write timing ancillary value which defines the quantity of reconfiguration; and a storage device configured to store said write timing setting value and said write timing ancillary value;

wherein the storage device stores a plurality of write timing ancillary values, the write timing ancillary values are associated with a color and a page position where the color toner component will be transferred, respectively, and the page position is a first page, a last page, or an intervening page.

3. A writing controlling device for image forming apparatus comprising:

means for detecting the time lag between the synchronization signal generated by synchronization detecting means for defining the writing starting position in a main scanning direction and a mark signal generated by mark sensor detecting means for detecting the mark on means for transferring the plural color toner components;

means for reconfiguring a white line insertion value output by said means for detecting and a predetermined writing timing setting value defining a writing start position in a sub-scanning direction according to a the writing timing ancillary value for defining the quantity of reconfiguration, the white line insertion value reflecting the number of white lines to be inserted; and means for storing a plurality of write timing ancillary values, wherein the write timing ancillary values are associated with a color and a page position where the color toner component will be transferred, respectively, and the page position is a first page, a last page, or an intervening page.

4. A method for forming an image, comprising the steps of:

detecting a time lag between a synchronization signal corresponding to a write starting position in a main scanning direction and a mark signal corresponding to detection of a mark provided on a transfer belt;

outputting a white line insertion value using the detected time lag, the white line insertion value reflecting the number of white lines to be inserted;

reconfiguring the white line insertion value and a write timing setting value defining a writing start position in a sub-scanning direction using a write timing ancillary value which defines the quantity of reconfiguration; and storing a plurality of write timing ancillary values, wherein the write timing ancillary values are associated with a color and a page position where the color toner component will be transferred, respectively, and the page position is a first page, a last page, or an intervening page.

* * * * *